US006921287B2

(12) United States Patent
Sheng et al.

(10) Patent No.: US 6,921,287 B2
(45) Date of Patent: Jul. 26, 2005

(54) EXCHANGEABLE MODULE FOR AN ELECTRIC SYSTEM

(75) Inventors: Shark Sheng, Shenzhen (CN); Chih-Hsin Chin, Taipei (TW); Windy Wang, Shenzhen (CN)

(73) Assignee: Phoenixtec Power Co., Ltd., Taipei (TW)

( * ) Notice: Subject to any disclaimer, the term of this patent is extended or adjusted under 35 U.S.C. 154(b) by 0 days.

(21) Appl. No.: 10/653,481

(22) Filed: Sep. 2, 2003

(65) Prior Publication Data

US 2005/0037662 A1 Feb. 17, 2005

(51) Int. Cl.[7] ..... H01R 31/08

(52) U.S. Cl. ..... 439/507; 439/509; 439/911; 200/16 F; 200/50.14

(58) Field of Search ..... 439/507, 509, 439/511, 911, 952; 307/28, 66, 80, 26; 200/50.14, 16 F; 429/97

(56) References Cited

U.S. PATENT DOCUMENTS 3,525,912 A * 8/1970 Wallin ..... 318/17
4,851,963 A * 7/1989 Miller et al. ..... 361/643
5,404,090 A * 4/1995 Shinbori ..... 307/66
5,567,173 A * 10/1996 Franckx ..... 439/418
5,606,851 A * 3/1997 Bruener et al. ..... 56/11.9
5,607,315 A * 3/1997 Bonnah et al. ..... 439/130
5,724,200 A * 3/1998 Mochizuki ..... 359/877
5,818,015 A * 10/1998 Lee et al. ..... 219/723
6,056,592 A * 5/2000 Hashizawa et al. ..... 439/509
6,195,970 B1 * 3/2001 Held et al. ..... 56/16.7

* cited by examiner

*Primary Examiner*—Neil Abrams
(74) *Attorney, Agent, or Firm*—William E. Pelton, Esq.

(57) ABSTRACT

An exchangeable module or battery 20 is wired to null terminals a, c. A main device 30 is joined to circuit terminals b, d. A connector 10 with a pair of shunt plates 11, 12 is used to electrically connect terminal a to b and terminal c to d, in order to connect the battery to the main device. The connector may be mounted in a cover panel 42, 43. In one embodiment (FIG. 6), the connector 10 is mounted to the exchangeable module for automatic separation from the terminals when the module is moved.

12 Claims, 8 Drawing Sheets

EXCHANGEABLE MODULE FOR AN ELECTRIC SYSTEM

BACKGROUND OF THE INVENTION

1. Field of the Invention

The present invention relates to an exchangeable module for an electric system and more particularly to an exchangeable module that easily and safely is replaced from the electric system.

2. Description of Related Art

The European standard "EN60950: Safety of Information Technology Equipment" stipulates protection in operator access areas in EN60950 2.1.1. EN60950 1.2.8.2 defines a primary circuit is directly connected to the AC main supply, and EN60950 1.2.8.3 defines a secondary circuit has no direct connection to a primary circuit and derives its power from a transformer, converter or equivalent isolation device, or from battery. Power supplied to a secondary circuit is provided through a transformer, a current transformer or insolating circuit. According to the standard, to protect the operator from hazards, a common safety design in operator access areas is the Safety Extra Low Voltage (SELV) circuit that has reinforced insulation from primary circuit. This device is insulation type electronic device. However the reinforced insulation is complex and is hard to design, so the cost of this device is very high. Another common safety design uses a safety interlock by a hardware device to prevent a user from directly touching the primary circuit. This device is a Primary type electronic device. Based on this, a space for reinforce insulation between the operator access area and the primary circuit is required when the operator replace the internal power. Therefore the hardware device is also very complex and hard to design.

Electronic modules used more often recently to add or extend capabilities of parent electronic devices necessitate the use of Safety of Information Technology Equipment to ensure safe operation. Many electronic devices provide convenient means to connect electronic modules. However, some electronic modules are primary circuits, and Safety of Information Technology Equipment is required in the parent electronic device to protect users. For example, an uninterruptible power supply (UPS) basically has a primary circuit and battery modules. The battery modules have a useful life and must be periodically replaced in many cases without deactivating the UPS. This necessitates replacing the battery modules when the UPS is "hot" to maintain normal operation of the equipment attached to the UPS. In general, the design of the UPS comprises one of the following features:

(1) The battery charger circuit is designed as a safety extra low voltage circuit, so as to the insulated transformer is needed.

(2) Using a battery connector with reinforced insulation between the part where the user can touch and charger circuit (a primary circuit) when replace the battery modules. However, the first feature requires an extra power converter circuits that use a significant amount of space in the UPS and the cost is up. As for the second feature, the reinforced insulation required the connector to meet the safety requirements. Meanwhile, because all the power is come from battery when UPS operates in reverse mode, the current rating of the connector is so high. This also causes the cost to go up significantly.

With reference to FIG. 8, a conventional connector (90) to connect the battery module (70) to the circuit (80) of the UPS (60) has a socket (91) and a plug (92). The plug (92) attaches to or detaches from the socket (91) to connect or disconnect the battery module (70) and circuit (80). The user has to manually connect or disconnect the connector (90) so as to a cheap connector (90) without reinforced insulation to the operator can be very dangerous.

The present invention provides a power source connector to mitigate or obviate the aforementioned problems.

SUMMARY OF THE INVENTION

The objective of the present invention is to provide an exchangeable module for an electronic system. The exchangeable module can easily and safely replace an internal power source in the electronic system.

Another objective of the present invention is to provide a low cost internal electric connecting device without complex circuit or expensive insulation transformers for an exchangeable module.

Other objectives, advantages and novel features of the invention will become more apparent from the following detailed description when taken in conjunction with the accompanying drawings.

DETAILED DESCRIPTION OF THE PREFERRED EMBODIMENT

Figure 3:
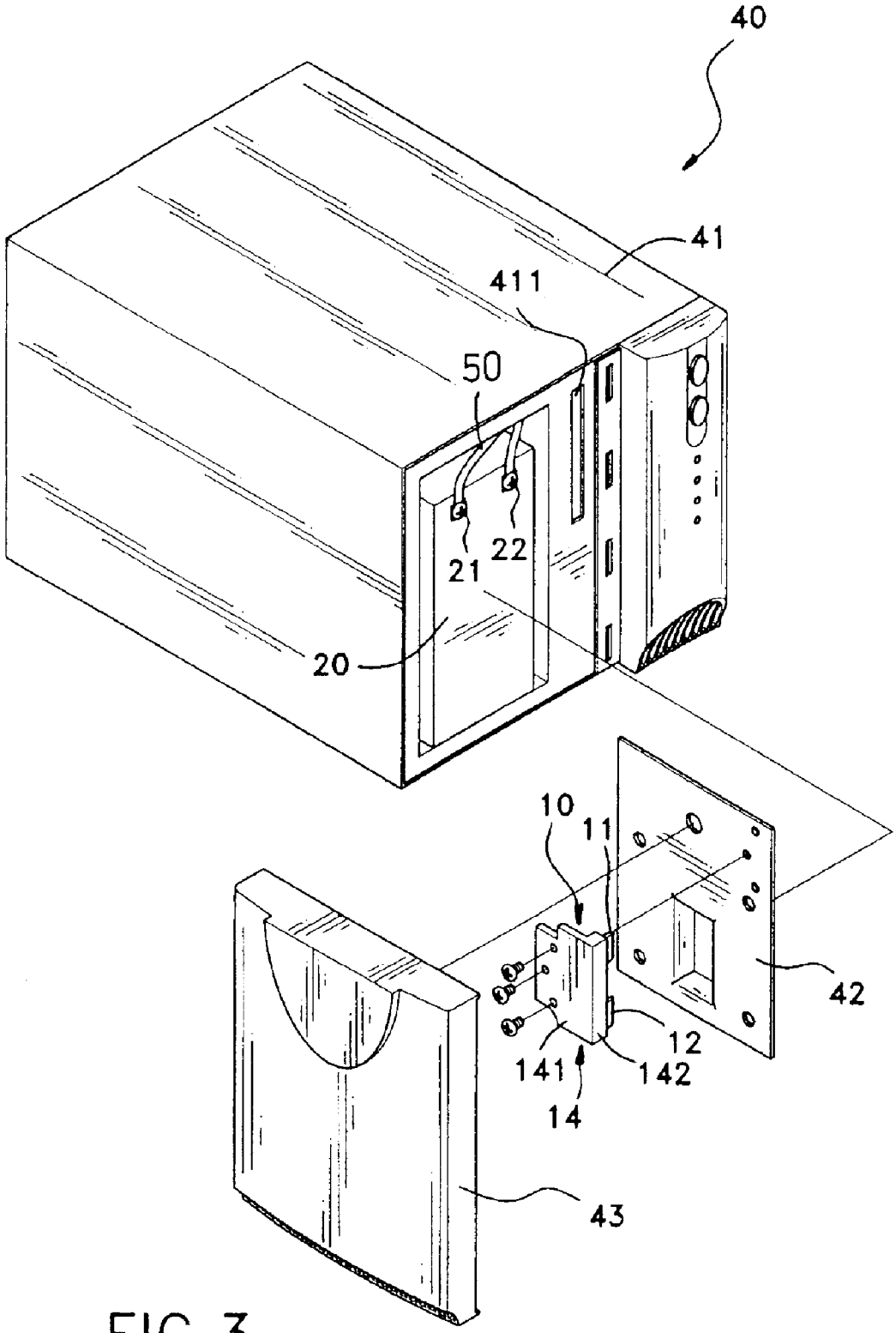
FIG. 3 is an exploded perspective view of an uninterruptible power supply (UPS) with a battery module in accordance with the present invention.
Figure 6:
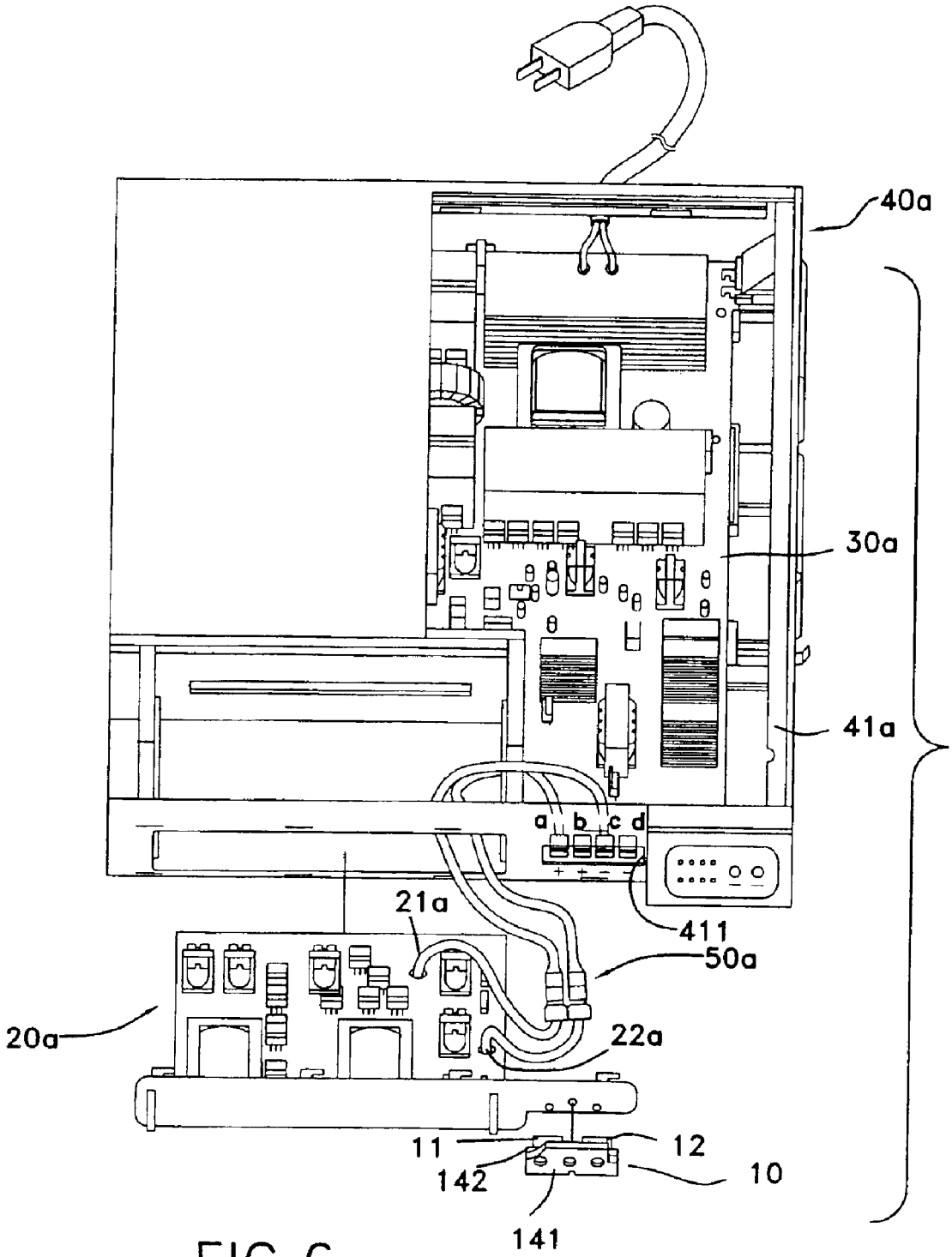
FIG. 6 is an exploded perspective view of another electric system having an exchangeable module in accordance with the present invention.

With reference to FIG. 1, an electronic system (1) includes a case, an AC main coupled electric device (30) retained in the case, an exchangeable module (20) and a conductive device (10). The AC main coupled electric device (30) has multiple null terminals (a, c) and circuit terminals (b, d). The null terminals (a, d) and the circuit terminals (b, d) are alternatively mounted on the AC main coupled electric device (30). The exchangeable module (20) is connected to the null terminals (a, c), and the conductive device (10) is used to connect the null terminals (a, c) and the circuit terminals (b, d). That is, the conductive device (10) is used to connect the AC main coupled electric device (30) to the exchangeable module (20). A portion of the conductive device (10) is mounted with the exchangeable module (20), as shown in FIG. 3 or FIG. 6. Therefore, a user can conveniently close or open the electric connection between the null and circuit terminals (a, c) (b, d) on the AC main coupled electric device (30) in the case. The exchangeable module (20) has a connector (50) as a wire set connected together between the AC main coupled electric device (30) and the exchangeable module (20). The exchangeable module (20) is able to be a battery module, a power module or a specific function controlled module.

Figure 1A:
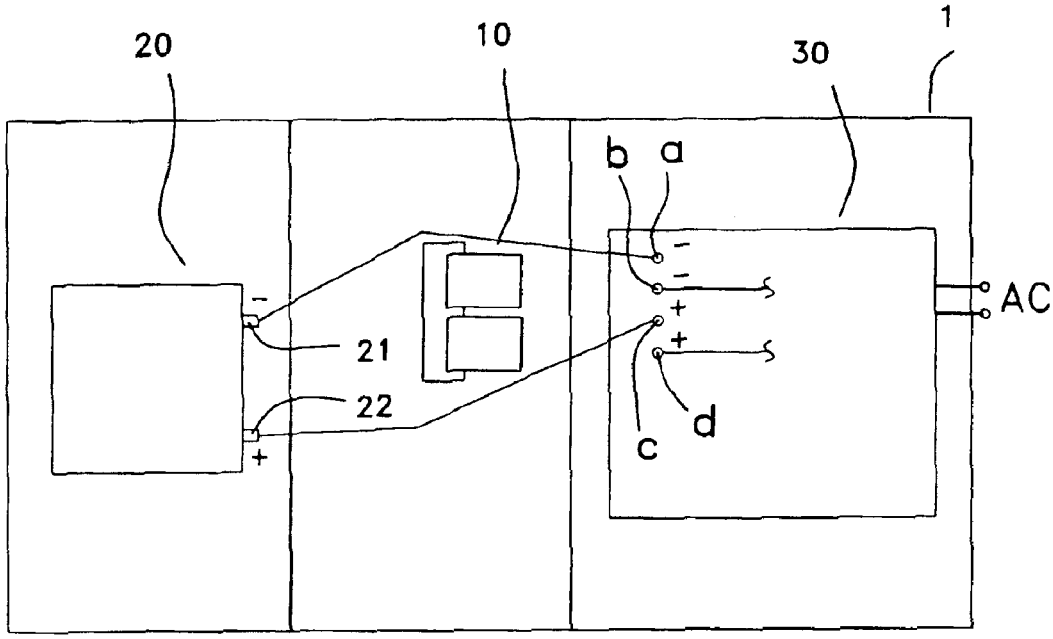
FIGS. 1A and 1B are wiring drawings of terminals on a main electric device and an exchangeable module in an electric system in accordance with the present invention.

With reference to FIG. 1A, the first embodiment of the present invention is shown. The exchangeable module (20) is a battery module, the AC main coupled electric device (30) is a printed circuit board (PCB) and the connector (50) is a wire set having two wires. Each wire is connected between the battery module and the PCB.

The battery module (20) has at least one negative power terminal (21) and one positive power terminal (22). The AC main coupled electric device (30) has multiple null terminals (a, c) connected respectively to the power terminal (21, 22) of the battery module (20) by the wires (50). A first null terminal (a) on the PCB (30) is securely connected to the negative power terminal (21) on the battery module (20), and a second null terminal (c) on the PCB (30) is securely connected to the positive power terminal (22) on the battery module (20). With the null terminals (a, c) hard-wired to the battery module (20), the first null terminal (a) has a negative potential (−), and the second null terminal (c) has a positive potential (+). A negative circuit terminal (b) and a positive circuit terminal (d) are formed on the PCB (30) respectively corresponding to the first and second null terminals (a, c). The null terminals (a, c) and the circuit terminals (b, d) are positioned in a line in corresponding pairs (a–b, c–d) with an equal distance between the null and circuit terminals (a–b, c–d) of each pair.

The conductive device (10) has at least one conductive switch plate (11, 12) corresponding to one pair of the null and circuit terminals (a, b) (c, d) on the PCB (30). In the preferred embodiment, the conductive device (10) has two conductive switch plates (11, 12), each of which is essentially rectangular with a length and a width and connects to the pairs of the null and circuit terminals (a–b, c–d) with the same electrical characteristic, for example both positive or both negative.

The width of each conductive switch plate (11, 12) is wider than the distance between the null and adjacent circuit terminals on the PCB (30). The conductive switch plate (11, 12) are used to connect to corresponding pairs (a–b, c–d).

Figure 1B:
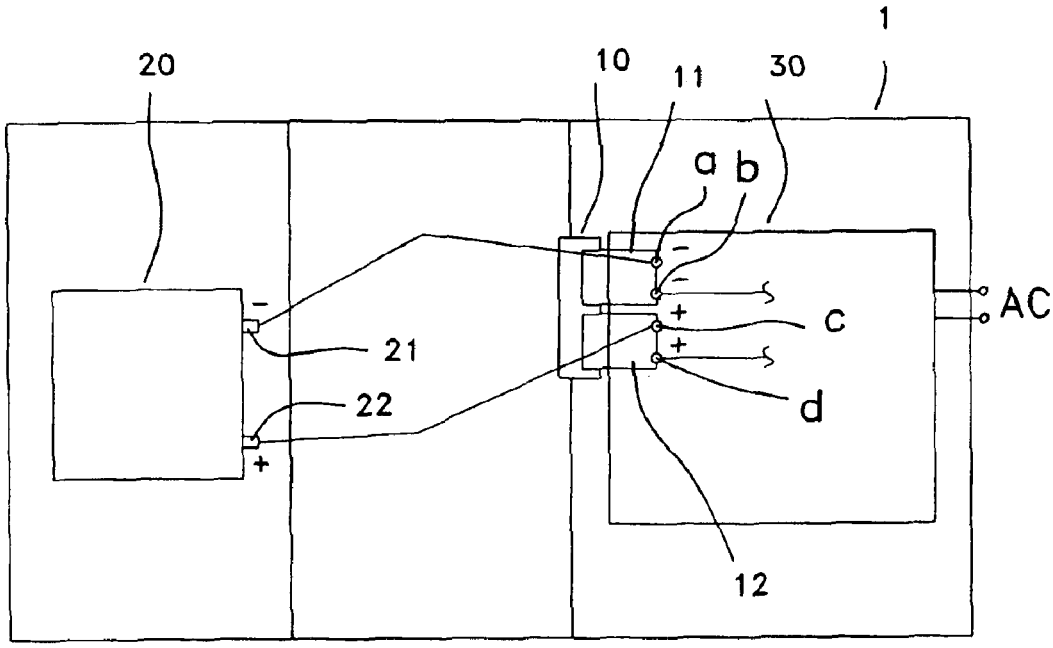

With reference to FIG. 1B, the appropriate electrical potential is applied to the corresponding circuit terminal (b, d) by connecting the null and circuit terminal in each pair (a–b, c–d) since the null terminals (a, c) are hard-wired to the corresponding power terminals (21, 22) on the battery module (20). When the battery module (20) needs to be disconnected from the PCB (30), the conductive device (10) only needs to be moved from the PCB (30) to disconnect the null and circuit terminals (a, b, c, d) on the PCB (30). The power between the battery module (20) and the PCB (30) is interrupted on the PCB (30) in this case so a user safely replaces a battery module (20) in the electronic system (1) without securing external power (not shown) to the electronic system (1).

Figure 2A:
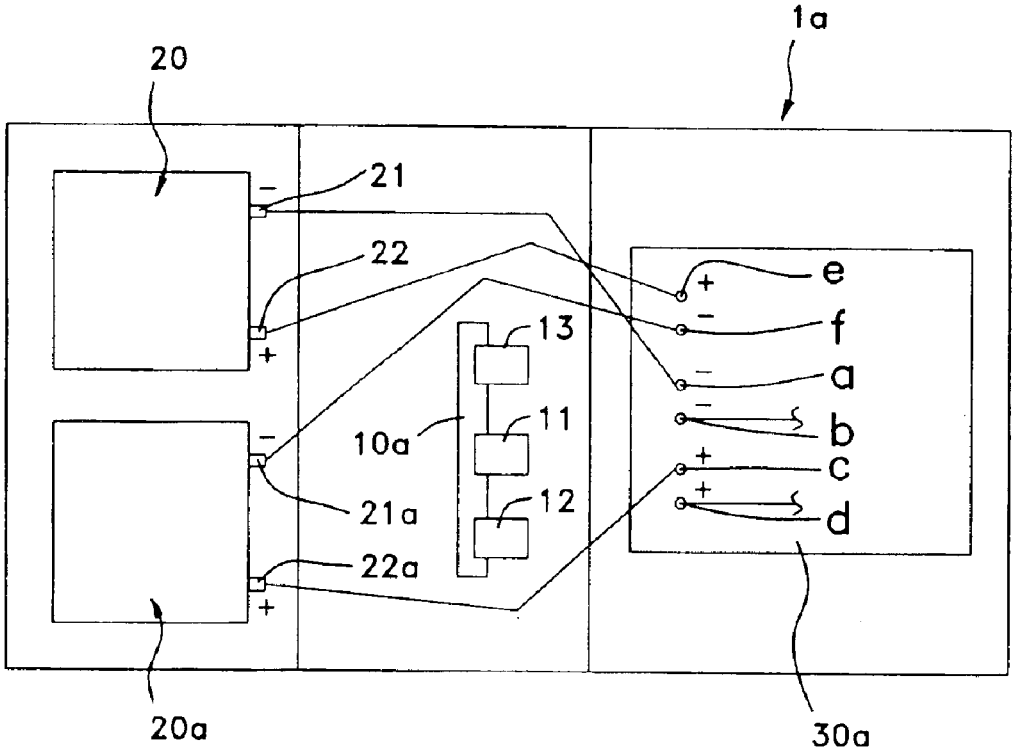
FIGS. 2A and 2B are wiring drawings of terminals on a main electric device and an exchangeable module in an electric system in accordance with the present invention.
Figure 2B:
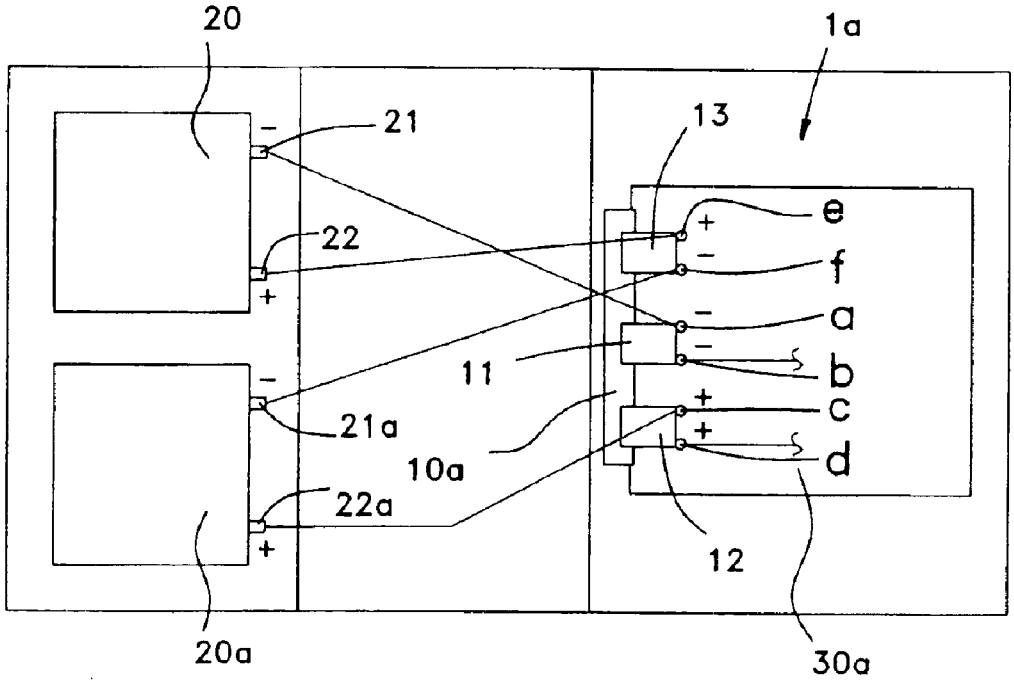

With reference to FIGS. 2A and 2B, an electronic device (1*a*) has battery module (20) that has two batteries (20*a*, 20*b*) to supply added power to a PCB (30*a*) and a conductive device (10*a*) with three conductive switch plates (11, 12, 13). The three conductive switch plates (11, 12, 13) correspond to four null terminals (a, c, e, f) and two circuit terminals (b, d) grouped in pairs on the PCB (30*a*). The first null terminal (a) is paired with the negative circuit terminal (b), the second null terminal (c) with the positive circuit terminal (d) as in the previously described PCB (30). The remaining two null terminals (e, f) are paired together to allow the two batteries (20*a*, 20*b*) to be connected in series. Each battery (20*a*, 20*b*) has a positive terminal (22*a*, 22*b*) and a negative terminal (21*a*, 21*b*). One of the remaining null terminals (e, f) is connected to a positive terminal (22*b*) of one battery (20*b*), and the other is connected to a negative terminal (21*a*) of the other battery (20*a*). When the conductive device (10*a*) connects to the PCB (30*a*), the two batteries (20*a*, 20*b*) are safely connected to the main electronic device (30*a*).

Based on the description and with reference to FIGS. 2A and 2B, the conductive device (10*a*) with multiple conductive switch plates (11, 12, 13) is used to connect or disconnect the pairs of terminals (a, b, c, d, e, f) on the PCB (30*a*). The user can safely disconnect the battery module (20) from the PCB (30*a*) and then replace the batteries (20*a*, 20*b*) after removing the conductive device (10*a*) (10) from the electronic system (1*a*).

Figure 4A:
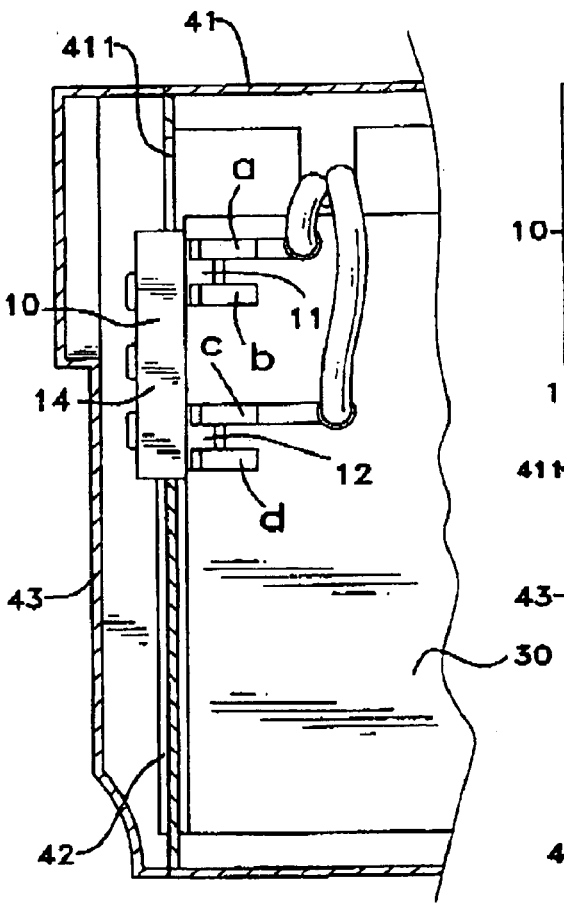
FIGS. 4A and 4B are cross sectional side plan views of a main electric device connected the battery module in FIG. 3.
Figure 4B:
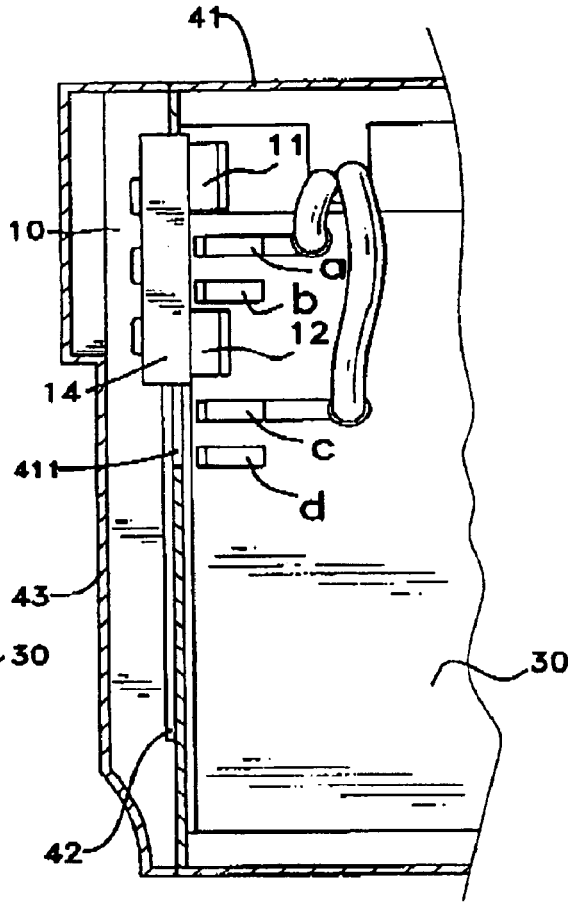

With reference to FIGS. 3, 4A and 4B, the electronic system is an uninterruptible power supply (UPS) (40). In addition to the power source connector (10), the UPS (40) has a case (41), an AC main coupled electric device (30) having four null and circuit terminals (a, c) (b, d), battery module (20) having a battery, a front cover (42) and a panel (43).

Figure 5:
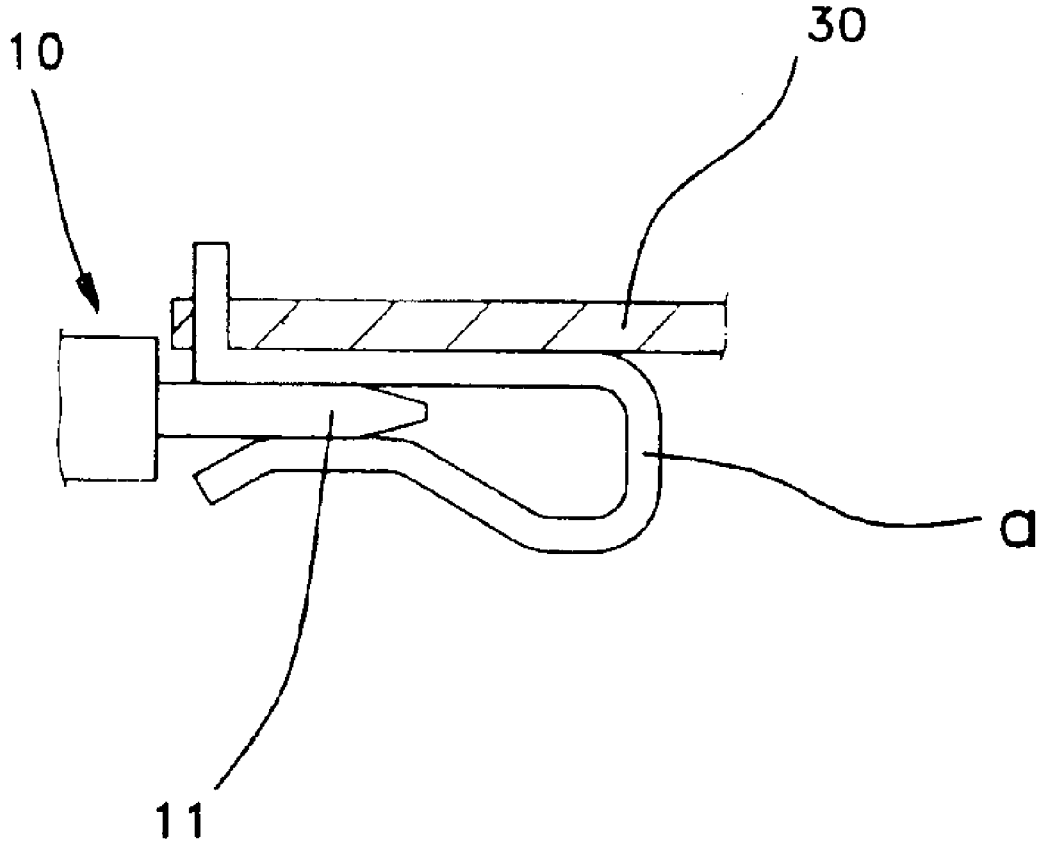
FIG. 5 is a cross sectional side plane view of a main electric device and the battery module in accordance with the present invention.

The AC main coupled electric device (30) and the battery module (20) are mounted in the same case (41). A slot (411) is defined in the case (41) and faces the null and circuit terminals (a, c) (b, d) of the electronic circuit (30) in the case (41). The null terminals (a, c) are connected to two power terminals (21, 22) of the battery module (20) by wires (50). With reference to FIG. 5, each null or circuit terminal (a) is a resilient U-shaped clip to clip the conductive switch plate (11) of the conductive device (10).

With reference FIG. 3, the conductive device (10) has an L-shaped power insulating body (14) having a long side (141) and a short side (142) and two conductive switch plates (11, 193 12) mounted on the short side (142) of the insulating body (14). The long side (141) of the conductive device (10) is mounted on the front cover (42) with screws (not numbered). The short side (142) of the power source connector (10) protrudes from the front cover (42) to insert into the slot (411) of the case (41) when the front cover (42) is mounted on the case (41).

With reference to FIG. 4A, the two conductive switch plates (11, 12) correspond to the pairs of null and circuit terminals (a, b, c, d) on the AC main coupled electric device (30). With reference to FIG. 4B, adjacent null and circuit terminals (a, b)(c, d) of each pair are electrically connected through the corresponding conductive switch plate (11, 12) of the conductive device (10). Because the conductive device (10) is mounted on the front cover (42), the front cover (42) is disassembled from the case (41) and then the conductive device (10) also is separated from the main electronic device (30) to disconnect the AC main coupled electric device (30) from the battery device (20).

Figure 7:
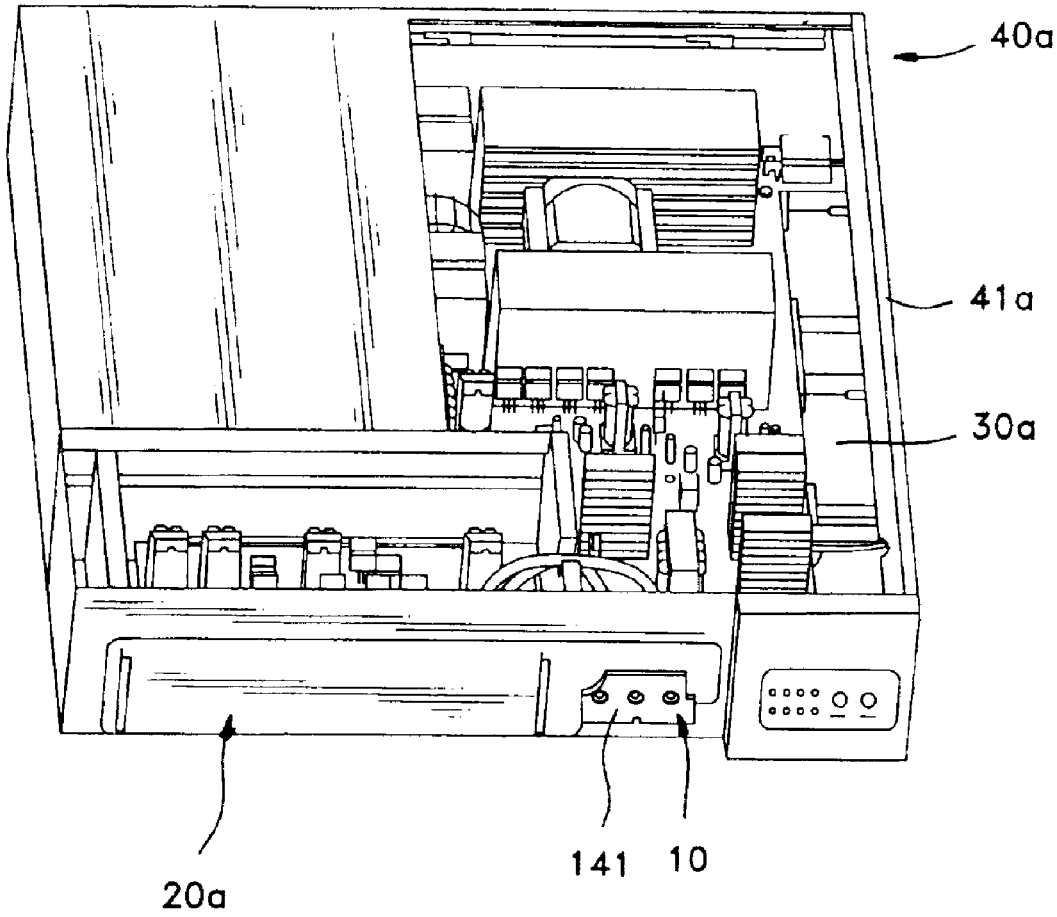
FIG. 7 is a perspective view of the electronic system in FIG. 6.
Figure 8:
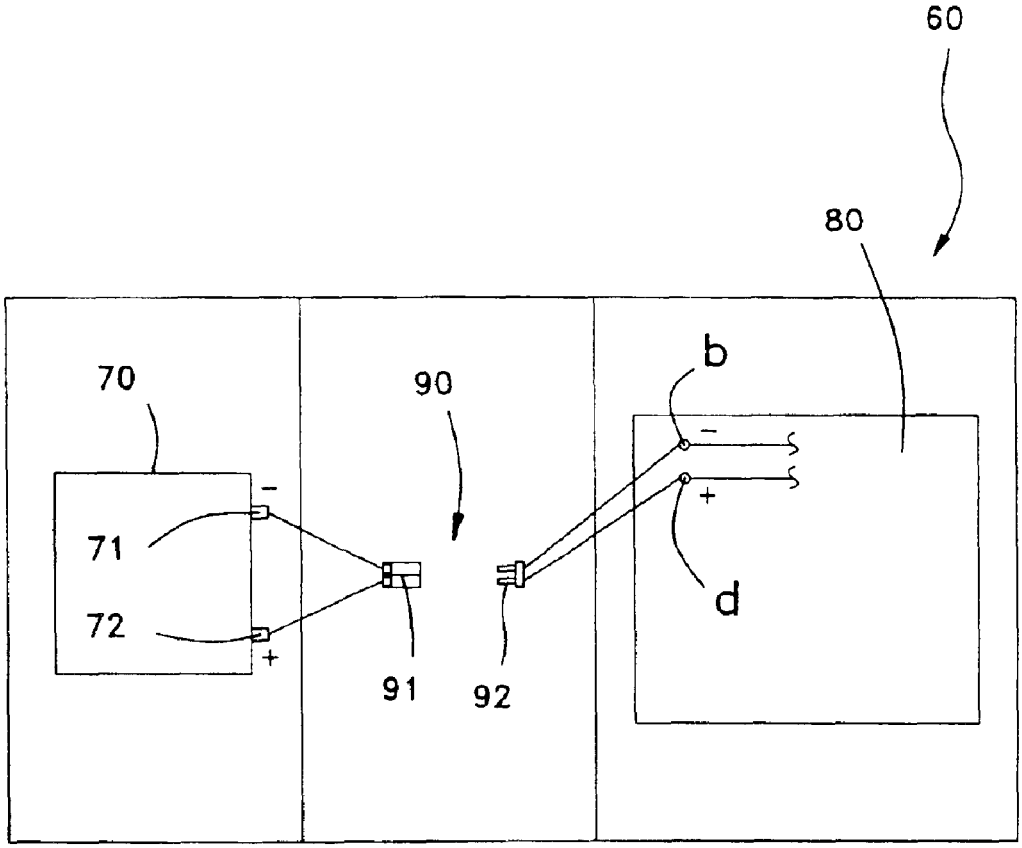
PRIOR ART FIG.8
FIG. 8 is a wiring drawing of a conventional power source connector.

With reference to FIG. 6 and FIG. 7, another electric system (40*a*) is shown. In this case, the electric system (40*a*) has a case (41*a*), having a slot (411*a*), an electronic circuit (30*a*), in the case (41*a*), an exchangeable module (20*a*) and connector (50*a*). The AC main coupled electric device (30*a*) supplies power to the exchangeable module (20*a*). The AC electric coupled device (30*a*) has terminals to which the exchangeable module (20*a*) is connected through the connector (50*a*). In the preferred embodiment, the exchange module (30*a*) is a circuit module. The connector (50*a*) consists of sockets and wires. The wires are respectively connected to the null terminals (a, c) and the circuit module, and the sockets are connected respectively between the wires. Therefore, the user can use the sockets to separate the circuit module (20*a*) and the AC main coupled electric device (30*a*). However, when the user prepares to separate the socket, the conductive device (10) has to be disconnected between the null and circuit terminals (a, b, c, d). The long side (141) of the conductive device (10) is mounted on the exchangeable module (20*a*), and the short side (142) is inserted into the slot (411*a*) of the case (41*a*) where the AC main coupled electric device (30*a*) is mounted. Therefore, each conductive switch plate (11, 12) connects to the corresponding adjacent null and circuit terminals (a, b, c, d) on the AC main coupled electric device (30*a*). When the exchangeable module (20*a*) is to be removed from the electronic device (30*a*), the user can conveniently and safely electrically disconnect the exchangeable module (20*a*) and the AC main coupled electric device (30*a*) by the conductive device (10) without reinforced insulation.

Based on the forgoing description, the electronic system use the conductive device without any transformer or protection circuit is used to connect or disconnect an internal power source from the main electric device in the case. Especially a main electric device connected to a high voltage power source in an electronic primary circuit. Consequently, the user does not need to touch the primary circuit to connect or replace the electronic units. Furthermore, the power source connector does not require complex electronic circuit or expensive transformers so the electronic device has a lower cost.

Although the present invention has been explained in relation to its preferred embodiment, it is to be understood that many other possible modifications and variations can be made without departing from the spirit and scope of the invention as hereinafter claimed.

What is claimed is:

1. An exchangeable module for an electric system, comprising:

a case;

an exchangeable module mounted on the case;

an AC main coupled electric device having multiple null terminals and circuit terminals and mounted in the case, wherein the null terminals are connected to the exchangeable module by a connector and alternatively formed on the AC main coupled electric device;

a conductive device mounted on the exchangeable module and corresponding to the null terminals and the circuit terminals on the AC main coupled electric device, the conductive device being separately connected to the null and circuit terminals on the AC main coupled electric device; whereby the conductive device is used to make or break electric connection between the exchangeable module and the AC main coupled electric device, the conductive device comprising:

an insulating body formed to be L-shaped having a long side and a short side where the multiple conductive switch plates are mounted; and multiple conductive switch elates respectively mounted on the insulating body, wherein each conductive switch plate corresponds to a pair of adjacent null and circuit terminals separated by a distance, has a width and electrically connects the pair of adjacent null and the circuit terminals.

2. The exchangeable device as claimed in claim 1, wherein the width of one conductive switch plate is larger than the distance between the two adjacent null and circuit terminals in a pair.

3. The exchangeable device as claimed in claim 1, wherein either one of the null terminals and the circuit terminals is a resilient clip.

4. The exchangeable device as claimed in claim 2, wherein either one of the null terminals and the circuit terminals is a resilient clip.

5. An electric system, comprising:

an AC main coupled electric device retained in a case and having null terminals and circuit terminals that are alternatively formed on the AC main coupled electric device; and an exchangeable module having terminals respectively corresponding to the null terminals, wherein the exchangeable module comprises:

a connector connected between terminals on a body of the exchangeable module and null terminals on the AC main coupled electric device retained in the electric system; and a conductive device mounted on the body to correspond to the null terminals and circuit terminals on the AC main coupled electric device, the conductive device being separately connected to the terminals on the AC main coupled electric device, and comprising;

an insulating body formed to be L-shaped having a long side and a short side where the multiple conductive switch plates are mounted; and multiple conductive switch plates respectively mounted on the insulating body, wherein each conductive switch plate corresponds to a pair of adjacent null and circuit terminals separated by a distance, has a width and electrically connects the pair of adjacent null and the circuit terminals; whereby the conductive device is used to make or break electric connection between the exchangeable module and the AC main coupled electric device.

6. The electric system as claimed in claim 5, wherein the width of one conductive switch plate is larger than the distance between the two adjacent null and circuit terminals in a pair.

7. The electric system as claimed in claim 5, wherein either one of the null terminals and the circuit terminals is a resilient clip.

8. The power source connector as claimed in claim 6, wherein either one of the null terminals and the circuit terminals is a resilient clip.

9. An uninterrupted power supply system, comprising:

an AC main coupled electric device retained in a case and having null terminals and circuit terminals, that are alternatively formed on the AC main coupled electric device; and a battery module having terminals respectively corresponding to the null terminals, wherein the exchangeable module comprises:

a connector connected between terminals on a battery of the battery module and null terminals on the AC main coupled electric device retained in the electric system; and a conductive device mounted on the battery to correspond to the null terminals and circuit terminals on the AC main coupled electric device, the conductive device being separately connected to the terminals on the AC main coupled electric device, and comprising:

an insulating body formed to be L-shaped having a long side and a short side where the multiple conductive switch plates are mounted; and multiple conductive switch plates respectively mounted on the insulating body, wherein each conductive switch plate corresponds to a pair of adjacent null and circuit terminals separated by a distance, has a width and electrically connects the pair of adjacent null and the circuit terminals;

whereby the conductive device is used to make or break electric connection between the battery module and the AC main coupled electric device.

10. The electric system as claimed in claim 9, wherein the width of one conductive switch plate is larger than the distance between the two adjacent null and circuit terminals in a pair.

11. The electric system as claimed in claim 9, wherein either one of the null terminals and the circuit terminals is a resilient clip.

12. The electric system as claimed in claim 10, wherein either one of the null terminals and the circuit terminals is a resilient clip.

* * * * *